US008133083B2

(12) United States Patent
Fujino et al.

(10) Patent No.: US 8,133,083 B2
(45) **Date of Patent: *Mar. 13, 2012**

(54) WATER JET PROPULSION BOAT

(75) Inventors: Kenichi Fujino, Shizuoka (JP); Shigeyuki Ozawa, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 553 days.

This patent is subject to a terminal disclaimer.

(21) Appl. No.: 12/247,276

(22) Filed: Oct. 8, 2008

(65) Prior Publication Data

US 2009/0093175 A1 Apr. 9, 2009

(30) Foreign Application Priority Data

Oct. 9, 2007 (JP) ..... 2007-263148

(51) Int. Cl.

| | |
|---|---|
| ***B63B 35/73*** | (2006.01) |
| ***B63H 21/38*** | (2006.01) |
| ***F02D 41/32*** | (2006.01) |
| ***F02D 45/00*** | (2006.01) |
| ***F02M 37/04*** | (2006.01) |
| ***F02M 37/08*** | (2006.01) |
| ***F02M 37/10*** | (2006.01) |

(52) U.S. Cl. ..... 440/1; 440/88 F; 73/114.41; 73/114.43; 123/387; 123/198 DB

(58) Field of Classification Search ..... 440/88 R, 440/88 F, 1; 73/114.41, 114.43; 123/332, 123/333, 379, 380, 387

See application file for complete search history.

(56) References Cited

U.S. PATENT DOCUMENTS

| | | | | |
|---|---|---|---|---|
| 5,762,040 | A * | 6/1998 | Taipale et al. | 123/299 |
| 5,902,158 | A * | 5/1999 | Nakase et al. | 440/88 R |
| 7,182,656 | B2 * | 2/2007 | Nanami et al. | 440/1 |
| 7,798,872 | B2 * | 9/2010 | Fujino et al. | 440/1 |

FOREIGN PATENT DOCUMENTS

JP 2002-161800 A 6/2002

OTHER PUBLICATIONS

Fujino et al.; "Abnormality Detection Device of Fuel Pump"; U.S. Appl. No. 12/247,278, filed Oct. 8, 2008.

* cited by examiner

*Primary Examiner* — Ajay Vasudeva
(74) *Attorney, Agent, or Firm* — Keating & Bennett, LLP

(57) ABSTRACT

A water jet propulsion boat is constructed such that a fuel pressure detection device is free from a detection error or breakdown and a restart ability of an engine is protected against malfunction. A fuel tank is provided in a boat body of the water jet propulsion boat through vibration absorbing members. A fuel pump unit including a fuel pump is provided in the fuel tank. A fuel pressure sensor is provided in the fuel pump unit. An electric control device stops the fuel pump if the value detected by the fuel pressure sensor is out of the normal value range. Additionally, an electric control device stops operation of the fuel pump if the fall sensor detects the overturning of the boat body and if the detected value of the fuel pressure sensor is out of the normal value range. A regulator and a filter are provided to the fuel pump unit.

14 Claims, 9 Drawing Sheets

WATER JET PROPULSION BOAT

BACKGROUND OF THE INVENTION

1. Field of the Invention

The present invention relates to a water jet propulsion boat equipped with a fuel pressure detection unit arranged to detect the pressure of the fuel delivered from a fuel tank to an engine.

2. Description of the Related Art

Some water jet propulsion boats are equipped with a fuel pressure detection device for detecting the pressure of the fuel supplied from the fuel tank to the engine. Failure states of the fuel system can be known from the pressure of the fuel supplied to the engine that is detected by the fuel pressure detection device (refer to JP-A-2002-161800, for example). This type of water jet propulsion unit has a fuel pressure sensor to detect the fuel pressure in a fuel pipe connecting the fuel tank and engine. The fuel pressure sensor detects the pressure of the fuel flowing through the fuel pipe. If the detected value is abnormal, the fuel pressure sensor may perform actions such as setting off an alarm or stopping the fuel pump operation.

The water jet propulsion boats are often exposed to hard vibrations since they are highly motile and plane in high speed on the wavy water surface. A sensor is used in general as a fuel pressure detection device. This sensor is made of precise instruments, so it is easily damaged by such vibrations. Therefore, the vibration forcing on the water jet propulsion boat may cause an error in the value detected by the fuel pressure sensor and also may damage the fuel pressure detection device. In order to protect the sensor from the vibration, the fuel pressure detection device or its attachment structure must be strong enough to ensure against damage caused by the hard vibration.

If the conventional water jet propulsion boat is overturned, the air sucked into the fuel pump resulting from the fuel tank turned upside down may reach to the piping. As a result, the engine may not start normally after the engine has been stopped and then is attempted to be re-started again.

SUMMARY OF THE INVENTION

In order to solve the problems described above, preferred embodiments of the present invention provide a water jet propulsion boat in which the fuel pressure detection device is free from detection error and breakdown and the restart ability of the engine is protected against malfunction.

According to a preferred embodiment of the present invention, a water jet propulsion boat propelled by rearwardly ejecting water that has been drawn through a jet pump driven by an engine includes a fuel tank disposed in the boat body of the water jet propulsion boat through a supporting member for absorbing vibrations; a fuel pipe extending from the fuel tank to the engine; a fuel pump unit including a fuel pump that is controlled by a control device to supply fuel in the fuel tank through a fuel pipe to the engine; a fuel pressure detection device, disposed in the fuel tank, arranged to detect the pressure of the fuel supplied to the engine by the fuel pump.

The water jet propulsion boat according to a preferred embodiment of the present invention is equipped with a fuel pressure detection device in the fuel tank disposed in the boat body through supporting members for absorbing vibrations. The fuel pressure detection device is attached in the fuel tank and mounted by using a vibration absorbing structure in a position spaced apart from the engine that generates vibrations in the boat body. Therefore, the fuel pressure detection device can be protected against vibration without the need or assistance of additional supporting members for absorbing vibration. As a result, detection errors occurring in the fuel pressure detection device can be prevented, and at the same time, the lifetime of the fuel pressure detection device can be significantly increased.

The fuel pressure detection device can be located in the vicinity of the fuel pump since the fuel pump unit is in general disposed in the vicinity of the fuel tank or inside the fuel tank. Therefore, the fuel pressure detection device in the vicinity of the fuel pump can detect the pressure decrease of fuel without delay when the air is sucked into the fuel pump, for example, when the water jet propulsion boat has overturned.

In addition, the water jet propulsion boat according to a preferred embodiment of the present invention has a feature in which the fuel pressure detection device is connected to the control device, and the control device stops the operation of the fuel pump when the fuel pressure detected by the fuel pressure detection device is not out of the predetermined normal value range.

The operation of the fuel pump itself stops when the fuel pump sucks the air and the fuel pressure detection device detects the pressure decrease of fuel, therefore, the intrusion of air into the fuel pipe beyond the fuel pump can be avoided. As a result, the restart ability of the engine is protected against malfunction. Additionally, the fuel pump stops operation and then the engine stops operation also in a case when the fuel pressure detection device detects the pressure increase of fuel caused by abnormality or the like, therefore the water jet propulsion boat cannot continue the planing in an abnormal state.

In this case, the control device can be adapted to stop the fuel pump when the fuel pressure detection device detects the abnormal value over a predetermined period of time. The fuel pump may occasionally suck the air according to shakes or vibrations experienced by the boat body, for example, in a case where the boat body is not overturned but planing normally, however the remaining amount of the fuel is low. The stopping of the engine is not preferable as long as the boat body is planing normally. If the water jet propulsion planes normally, it cannot be expected that the fuel pump continuously sucks the air. In this case, the effect on the engine is not significant. Therefore, unnecessary engine stops can be avoided by stopping the fuel pump operation to stop the engine only if the detected value of the fuel pressure detection device is not in the normal value range and if the abnormal state continues over a predetermined period of time.

In addition, the water jet propulsion boat according to a preferred embodiment of the present invention has another feature, in which the fuel pressure detection device is connected to the control device; a fall sensor is equipped to the boat body and is connected to the control device; the fall sensor detects overturning of the boat body; and the control device stops the operation of the fuel pump when the detected value of the fuel pressure detection device is out of the predetermined normal value range.

In a case in which the boat body is overturned however and is assumed to return to the normal state quickly and then continues planing, the stopping of the engine is not preferable. If the water jet propulsion planes normally, it cannot be expected that the fuel pump continuously sucks the air. In this case, the effect on the engine is not significant. Thus, the fuel pump stops when the fall sensor detects overturning of the boat body and the detected value of the fuel pressure detection device is out of the normal value range, in other words only when the fuel pump is expected to suck the air continuously. In this way, unnecessary stoppage of the engine is avoided.

In addition, the water jet propulsion boat according to a preferred embodiment of the present invention has a feature in which the fuel pump unit is constituted as an element of the fuel tank and the fuel pressure detection device is provided to the fuel pump unit. According to this, the fuel pump and the fuel pressure detection device can be located closer to each other, and the fuel pump and the fuel pressure detection device are preferably integrated as a single module. This structure facilitates a decrease in man-hours for assembly of the fuel pump unit and the fuel pressure detection device, and also allows a decrease in the number of necessary parts for assembly. The sentence "the fuel pump unit is constituted as an element of the fuel tank" also means the fuel pump unit in the fuel tank is removable.

In addition, the water propulsion boat according to a preferred embodiment of the present invention has a feature in which, a regulator for controlling the pressure of the fuel sucked from the fuel tank to the fuel pump unit is disposed to the fuel pump unit, and the fuel pressure detection device is disposed in the downstream side of the fuel pump body, and the fuel pressure detection device detects the pressure of the fuel in which the pressure has been controlled by the regulator. According to this, more accurate detection of fuel pressure is possible in a case in which the fuel pressure is controlled, not by the method in which the excess fuel that is once sent to the engine is returned to the fuel tank side, but by the so called "returnless method" in which the fuel pressure is controlled by the regulator in the fuel pump unit.

In addition, the water jet propulsion boat according to a preferred embodiment of the present invention has a feature in which the fuel pump unit is disposed in the fuel tank such that as at least a portion of fuel pump unit is exposed above the fuel tank; and the fuel pressure detection device is attached to the exposed section of the fuel pump unit from the upper wall of the fuel tank. Maintenance operations such as exchanging of the fuel pressure detection device can be carried out easily since the fuel pressure detection device is attached to the upper portion of the fuel pump exposed above the fuel tank.

In addition, the water jet propulsion boat according to a preferred embodiment of the present invention has a feature in which the fuel discharge section in communication with the fuel pipe is disposed to the upper portion of the fuel pump unit exposed above the fuel tank; and the fuel pressure detection device is attached to the fuel discharge section. The fuel conduit that communicates the fuel pump unit and the fuel pressure detection device can be omitted by attaching the fuel pressure detection device to the fuel discharge section in this way. The fuel pump and the fuel pressure detection device can be located closer to each other, such that an abnormality in the fuel pressure can be immediately detected in a case an abnormality occurs.

In addition, the water jet propulsion boat according to a preferred embodiment of the present invention has a feature in which the fuel pressure detection device is attached inside of the fuel tank. According to this, the fuel pressure detection device is surrounded by the fuel (including the evaporated fuel), so that the fuel pressure detection device is protected against corrosion, damage, etc., which is caused by soaking in the seawater.

In addition, the water jet propulsion boat according to a preferred embodiment of the present invention has a feature in which the fuel pressure detection device is attached inside the fuel pump unit; and a filter for removing foreign matter from the fuel sucked in the fuel pump unit driven by the fuel pump is disposed at the downstream side of the fuel pressure detection device of the fuel pump unit. Accordingly, when the fuel pump sucks the air, the air reaches to the fuel pressure detection device before passing the filter, and the fuel pressure detection device detects the decrease of the fuel pressure. Therefore, the intrusion of the air into the fuel pipe can be reliably prevented.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIGS. 9A and 9B show a condition in which a fuel pressure sensor according to a reference example is attached to a fuel rail, in which FIG. 9A is a plan view and FIG. 9B is a side view of the main portion thereof.

DETAILED DESCRIPTION OF THE PREFERRED EMBODIMENTS

First Preferred Embodiment

Figure 1:
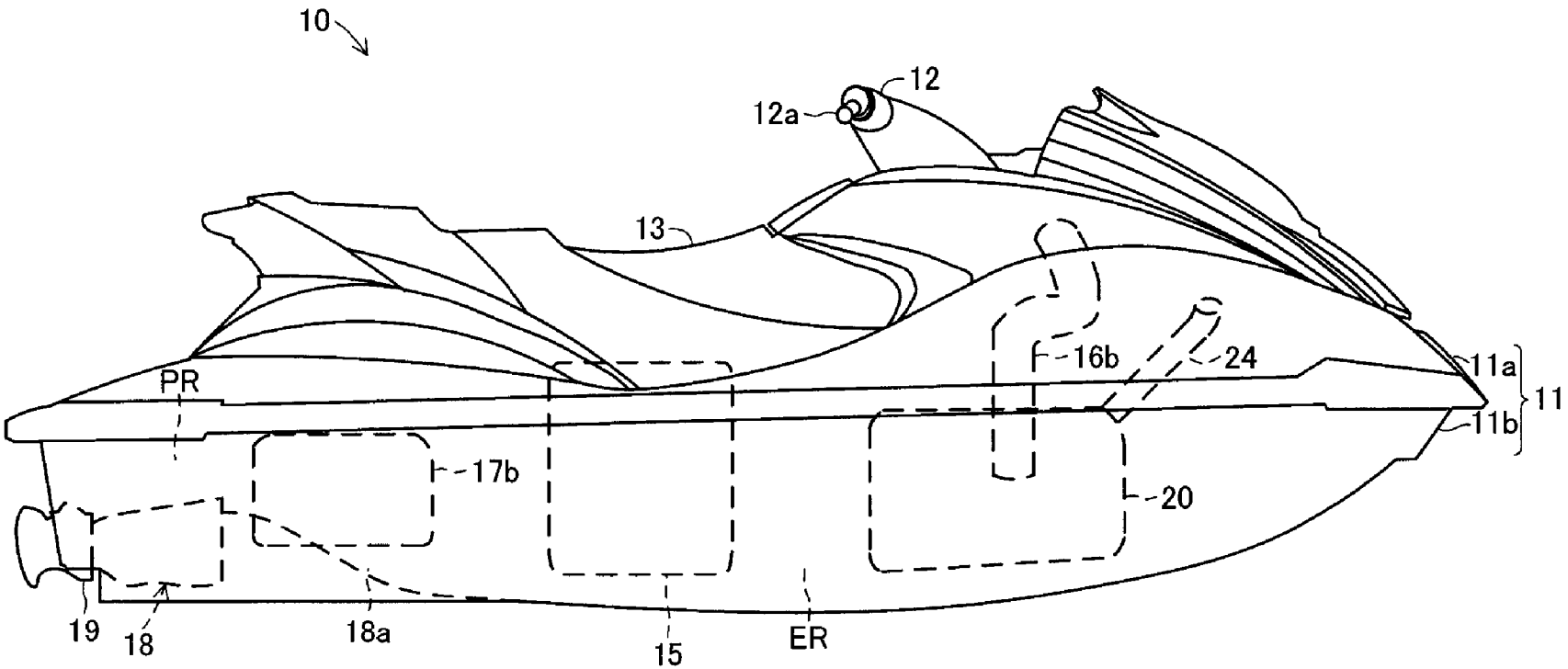
FIG. 1 is a side view of a water jet propulsion boat according to a first preferred embodiment of the present invention.
Figure 2:
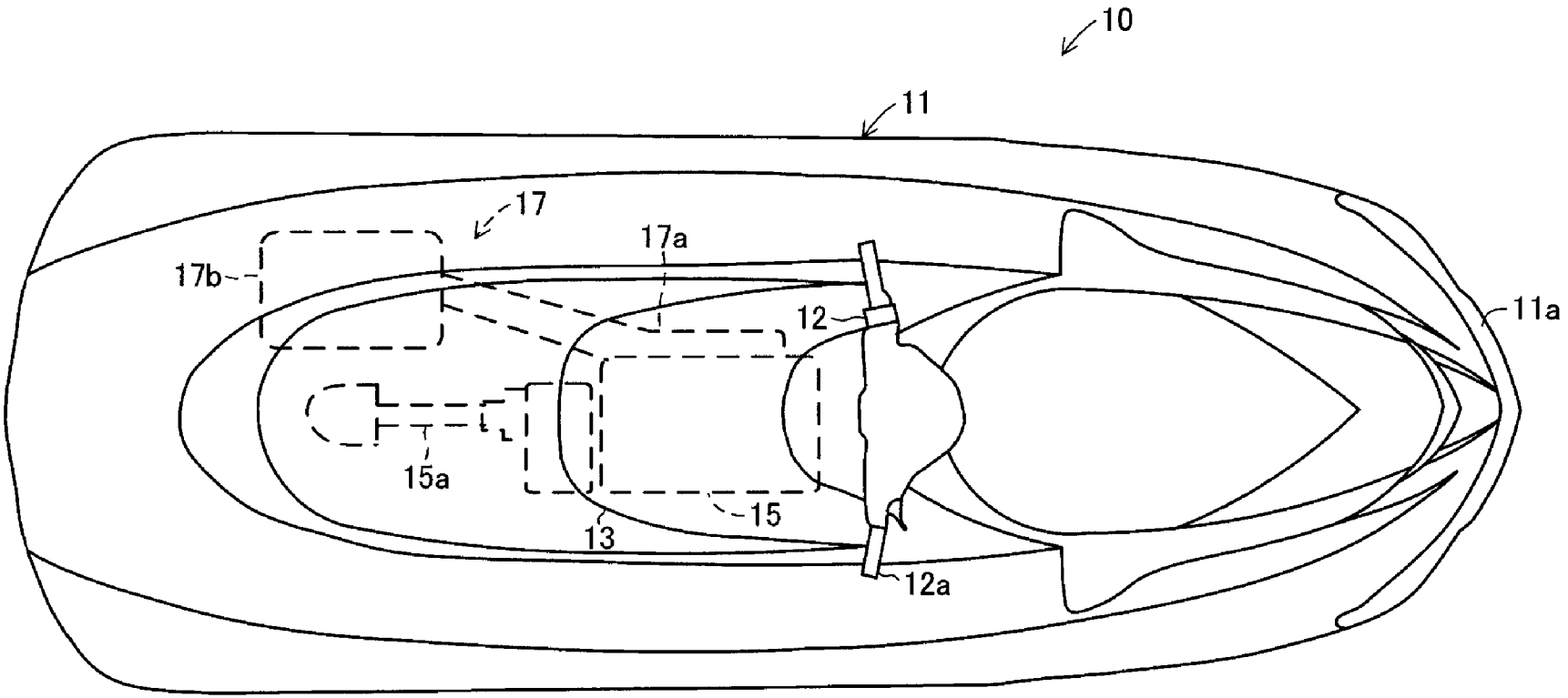
FIG. 2 is a plan view of the water jet propulsion boat shown in FIG. 1.

A first preferred embodiment of the present invention will now be described with reference to the drawings. FIGS. 1 and 2 show a water jet propulsion boat 10 according to a preferred embodiment of the present invention. In this water jet propulsion boat 10, a boat body 11 includes a deck 11*a* and a hull 11*b*. Steering handlebars 12 are preferably disposed more in a front area than a center in an upper portion of the boat body 11, and a seat 13 is preferably disposed at a center area in an upper portion of the boat body 11. The steering handlebars 12 are rotatably attached to the upper end of the steering shaft (not shown) disposed on the boat body 11.

A throttle lever (not shown) is disposed adjacent to a grip 12*a* on the right side (the starboard side) of the steering handlebars 12. The throttle lever is adapted to be pivotal toward the grip 12*a* when the boat operator operates the throttle lever, and pivotal apart from the grip 12*a* when the operator releases the throttle lever. An accelerator position sensor 14 (refer to FIG. 7) for detecting the operation amount of the throttle lever is disposed at the base side portion of the throttle lever. The interior of the boat body 11 is constituted with an engine room ER that extends from its front portion to central portion, and a pump room PR located at its rear portion.

Figure 3:
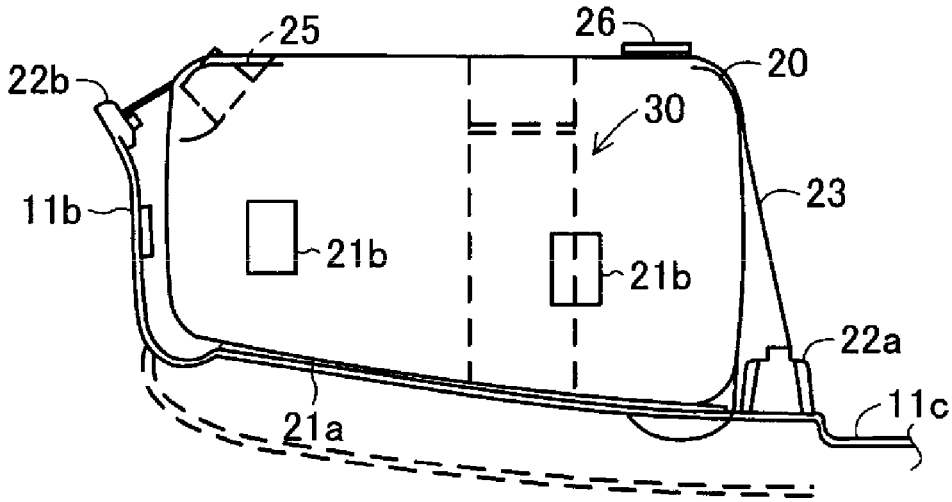
FIG. 3 is a cross sectional view of a mount structure of a fuel tank as seen from the side.
Figure 4:
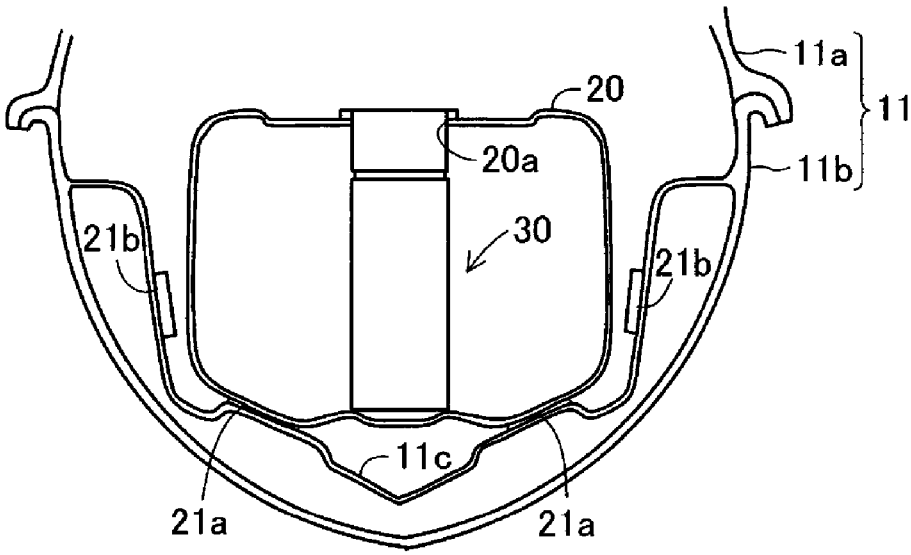
FIG. 4 is a cross sectional view of the mount structure of the fuel tank as seen from the front.

The engine room ER is provided with a fuel tank 20, an engine 15, an intake system 16 (refer to FIG. 6) including a throttle valve 16*a*, etc., an exhaust system 17 including an exhaust manifold 17*a*, etc. The pump room PR is provided with a propulsion unit 18 constituted with a jet pump, etc. An air duct 16*b* to introduce the external air into the engine room is disposed in the front portion of the engine room ER. The air duct 16*a* extends vertically from the upper portion of the boat body 11 to the bottom portion of the engine room ER. The air duct 16*a* sucks the external air from the upper end and introduces it into the bottom end then to the engine room ER. The fuel tank 20 is disposed at the front portion of the engine room ER as shown in FIGS. 3 and 4.

The hull 11*b* constituting the bottom portion of the boat body 11 is preferably has a dual structure construction in which, the fuel tank 20 is mounted through a plurality of vibration absorbing members 21*a*, 21*b*, on an inner wall 11*c* constituting the inner structure of the hull 11*b*. The vibration absorbing members 21*a* are preferably disposed in two places on both sides supporting the bottom of the fuel tank 20 on the bottom surface of the inner wall 11*c*, for example. The vibration absorbing members 21*b* are preferably disposed in three places that face to the side surfaces of the inner wall 11*c* other than the rear side surface of the fuel tank 20. A fastening hardware 22*a* is fixed on the inner wall 11*c* where the bottom rear end of the fuel tank 20 is located. Another fastening hardware 22*b* is fixed on the inner wall 11*c* (hull 11*b*) where the upper front end of the fuel tank 20 is located.

The belt 23 is wound around the fuel tank 20 through the fastening hardware 22*a* and 22*b*, so the upper surface of the fuel tank 20 is pressed down against the bottom wall 11*c*. Therefore, the fuel tank 20 is supported by the inner wall 11*c* such that the vibration of the boat body 11 is absorbed by the vibration absorbing member 21*a* and not transmitted directly to the fuel tank 20. If the fuel tank 20 deviates horizontally, the impact from the inner wall 11*c* on the side surface of the fuel tank 20 can be absorbed and dissipated by the vibration absorbing members 21*b*. The supporting member according to a preferred embodiment of the present invention is preferably constituted by the vibration absorbing members 21*a* and 21*b*.

The fuel tank 20 preferably is a substantially rectangular-shaped-container including a bottom wall. The bottom wall is arranged to be inclined so that the front portion of the bottom wall is higher than the rear portion of the bottom wall. An opening 20*a* is preferably formed in the top wall of the fuel tank 20, centrally in the left-right direction and rather rearward thereof. A connecting opening 25, which is in fluid communication with an oil feed pipe 24 extending from an oil fuel inlet formed in the deck 11*a*, is formed in the upper front end of the fuel tank 20. An opening that can be opened and closed with a lid 26 is formed in the upper rear end of the fuel tank 20. A fuel pump unit 30 is disposed in the fuel tank 20 with its upper surface being exposed through the opening 20*a*.

Figure 5:
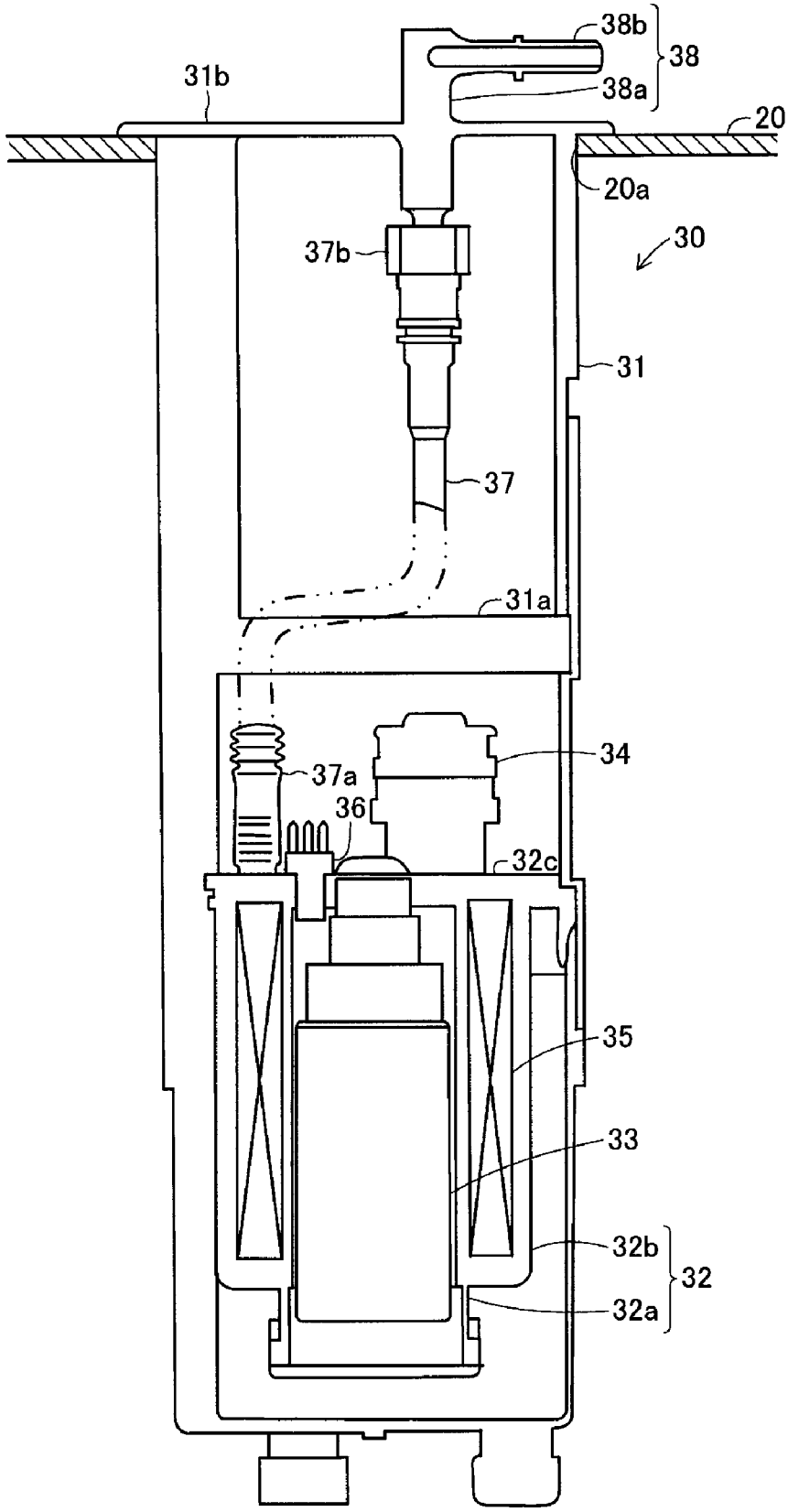
FIG. 5 is a cross sectional view of a fuel pump unit.

As shown in FIG. 5, the fuel pump unit 30 is constituted by dividing an elongated cylindrical container 31 into an upper room and a lower room with a partition 31*a*. A fuel pump 33, a regulator 34, a filter 35, and a fuel pressure sensor 36 as a fuel pressure detection device according to a preferred embodiment of the present invention are housed in the lower room via a housing 32. A connecting pipe 37 is disposed in the upper room. The housing 32 includes a pump housing section 32*a* to contain the fuel pump 33 and a case member having a filter housing section 32*b* to contain the filter 35. A cylindrical pump housing section 32*a* is formed at the center of the housing 32. An annular filter housing section 32*b* is formed around the outer surfaces of the pump housing section 32*a* except for the bottom surface.

The regulator 34 in communication with the inside of the pump housing section 32*a* is disposed at the rear portion of the pump housing section 32*a* (right side in FIG. 5) which is the upper surface 32*c* of the housing 32. The fuel pressure sensor 36 in communication with the inside of the pump housing section 32*a* is disposed at the front portion of the pump housing section 32*a* (left side in FIG. 5) which is the upper surface 32*c* of the housing 32. A suction port (not shown) to suck the fuel into the fuel pump 33 from the fuel tank 20 by operation of the fuel pump 33 preferably extends from the bottom surface of the container 31 to the upper surface of the bottom wall of the pump housing section 32*a*. A discharge port (not shown) to discharge the fuel sucked in the pump housing section 32*a* through the fuel pump 33 to the filter housing section side 32*b* is formed between the upper portion of the pump housing section 32*a* and the filter housing section 32*b*.

A grommet 37*a* is disposed on the upper surface 32*c* of the housing 32, corresponding to the front portion of the filter housing section 32*b*, next to the fuel pressure sensor 36. The grommet 37*a* is in communication with the inside of the filter housing section 32*b*. The bottom end of the connecting pipe 37 is connected to the grommet 37*a*. The connecting pipe 37 extends through the partition 31*a* into the upper room of the container 31. A check valve 37*b* is disposed at the upper end of the connecting pipe 37. The connecting pipe 37 is connected, through the check valve 37*b*, to a fuel discharge section 38 located on the top wall 31*b* of the container 31. The fuel discharge section 38 is constituted by a body portion 38*a* and a connecting portion 38*b*. The body portion 38*a* extends from the inside of the container 31 to the outside through the upper wall 31*b* of the container 31. The connecting portion 38*b* bends at the upper end of the body portion 38*a* and then extends horizontally rearward. The connecting portion 38*b* is connected to the upper stream end of the rubber fuel pipe 39 (refer to FIG. 6).

Therefore, when the fuel pump 33 is operated, the fuel in the fuel tank 20 is drawn from the suction port through the fuel pump 33 into the pump housing section 32*a*, and has its pressure controlled by the regulator 34, and then discharged into the filter housing section 32*b*. At the same time, the fuel pressure is detected by fuel pressure sensor 36 disposed in the vicinity of the discharge port. The fuel discharged in the filter housing section 32*b* is filtered by the filter 35 in order to remove foreign matters and then drawn into the engine 15 through the connecting pipe 37 and the fuel pipe, etc. The fuel delivered from the connecting pipe 37 through the fuel discharge section 38 to the fuel pipe 39 is drawn towards the engine 15 in a state such that backflow of the fuel is prevented by the check valve 37*b*.

The engine 15 is preferably disposed at the rear portion of the engine room ER (center of the bottom in the boat body 11). An intake device 16 and an exhaust device 17 are connected to the engine 15. The intake device feeds a mixture to the engine 15. The mixture includes the fuel supplied from the fuel tank 20 and the air taken from the outside. The exhaust device 17 releases the exhaust gas discharged from the engine 15 to the outside through a rear end portion of the boat body 11. Although not shown, the engine 15 preferably is a four-stroke-four-cylinder type engine, for example. Each cylinder is preferably provided with an intake valve and an exhaust valve. As the intake and exhaust valves are selectively opened and closed, the mixture of fuel and air is taken into the engine 15 from the intake system on the intake valve side, and an exhaust gas is delivered to the exhaust system 17 on the exhaust valve side.

At this time, the mixture supplied into the engine 15 from the intake valve explodes with the ignition of the ignition device of the engine 15. The explosion makes a piston in each cylinder of the engine 15 move in a reciprocal manner. The motion of the piston rotates a crankshaft. The crankshaft is coupled with an impeller shaft 15*a*. The crankshaft transmits the rotational force of the engine 15 to the impeller shaft 15*a* for rotation. Also, the rear end portion of the impeller shaft 15*a* is coupled with an impeller (not shown) of the propulsion unit 18 mounted at the rear end portion of the boat body 11. The rotation of the impeller generates a propulsive force in the water jet propulsion boat 10.

The propulsion unit 18 has a water inlet port 18*a* that opens at the bottom of the boat body 11 and a water outlet port (not shown) that opens at the stern. The propulsion unit 18 introduces seawater from the water inlet port 18*a*, and ejects it from the water outlet port by the rotation of the impeller to generate the propulsive force for the boat body 11. A steering nozzle 19 is attached to the rear end portion of the propulsion unit 18. The rear portion of the steering nozzle 19 is rotatable in the left or right direction. The advance direction of the water jet propulsion boat 10 is controlled by the operation of the steering handlebars 12.

Figure 6:
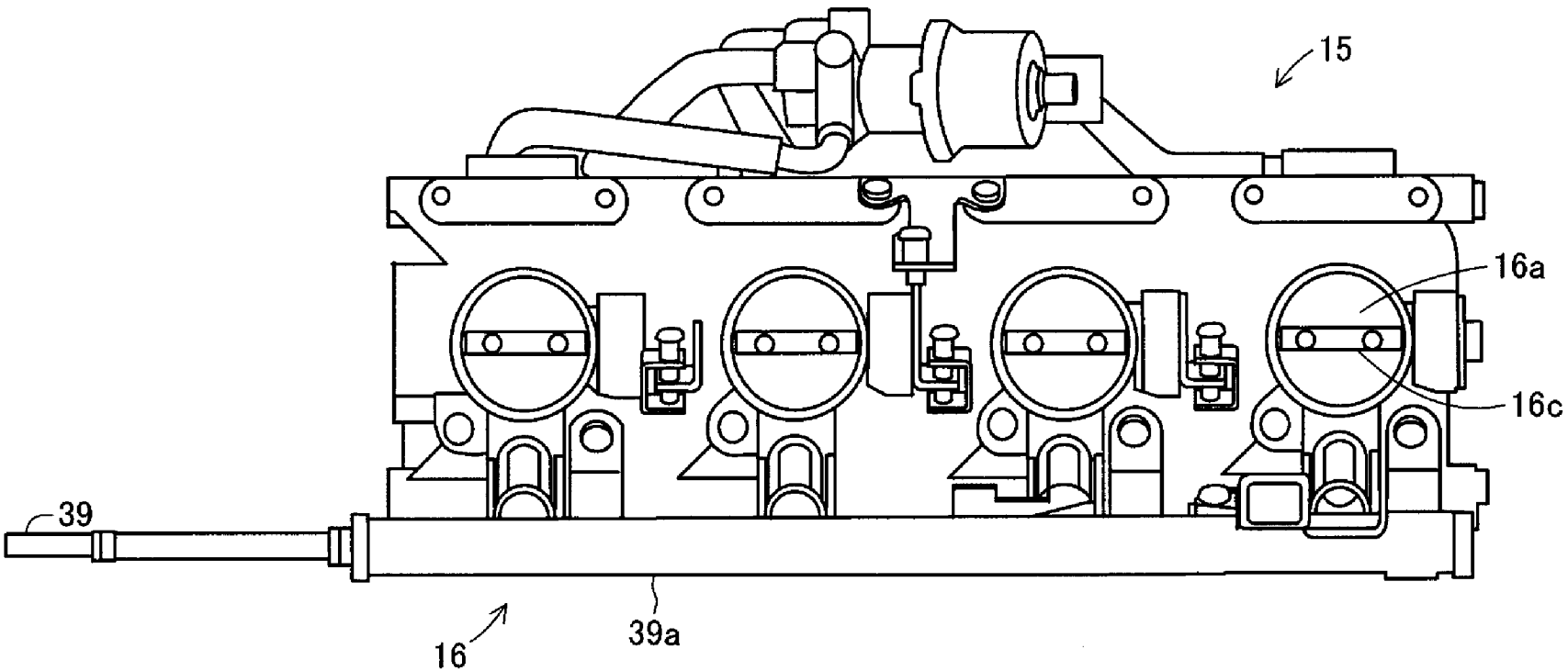
FIG. 6 is a plan view of a positional relation between an engine and a fuel rail.

The intake system 16 includes intake pipes connected to the engine 15, throttle bodies connected to the upstream ends of the intake pipes, and other components. The intake system 16 sucks the air from outside through an air duct 16*b* and an intake box (not shown) and the like, adjusts the air flow by the opening or closing operation of a throttle valve disposed in the throttle body, and then supplies the air to the engine 15. At the same time, the fuel is mixed with the air to be supplied to the engine 15. The fuel is delivered from the fuel tank 20 to the intake valves in each cylinder of the engine 15 through the fuel pipe 39 and fuel rail 39*a* which preferably is a metal pipe as shown in FIG. 6.

Also, the throttle valve 16*a* preferably has a disk shape. A pivot shaft 16*c* is affixed thereto at a center portion (in the diameter direction). The pivot shaft 16*c* is pivotally supported inside of the throttle body. A motor is connected to one end of the pivot shaft 16*c*. Thus, the throttle valve 16*a* pivots in the forward or reverse direction about the pivot shaft 16*c* with a rotary movement of the motor to open or close an intake passage extending inside of the throttle body. The adjustment of the throttle valve opening is made by the rotating operation of the throttle lever disposed on the steering handlebars 12.

The exhaust system 17 includes an exhaust manifold 17*a*, a tank-like water lock 17*b*, or the like. The exhaust manifold 17*a* preferably includes curved pipes connected to the engine 15. The water lock 17*b* is connected to the rear end of the exhaust manifold 17*a*. The exhaust manifolds 17*a* extend from the exhaust valve side in each cylinder of the engine 15, and then gather at the starboard side of the boat body 11, and then extend toward the port side of the boat body 11 as surrounding the front portion of the engine 15, and then extend rearward passing the vicinity of the side portion of the engine 15, and then communicate to the front portion of the water lock 17*b*. An exhaust pipe is disposed on the upper surface of the rear portion of the water lock 17*b*. The exhaust pipe once extends upward, then downward and rearward, and then opens at the rear end lower portion of the boat body 11. The exhaust system 17 discharges the exhaust gas externally under the condition that external seawater or the like is prevented from entering the engine 15 side.

Figure 7:
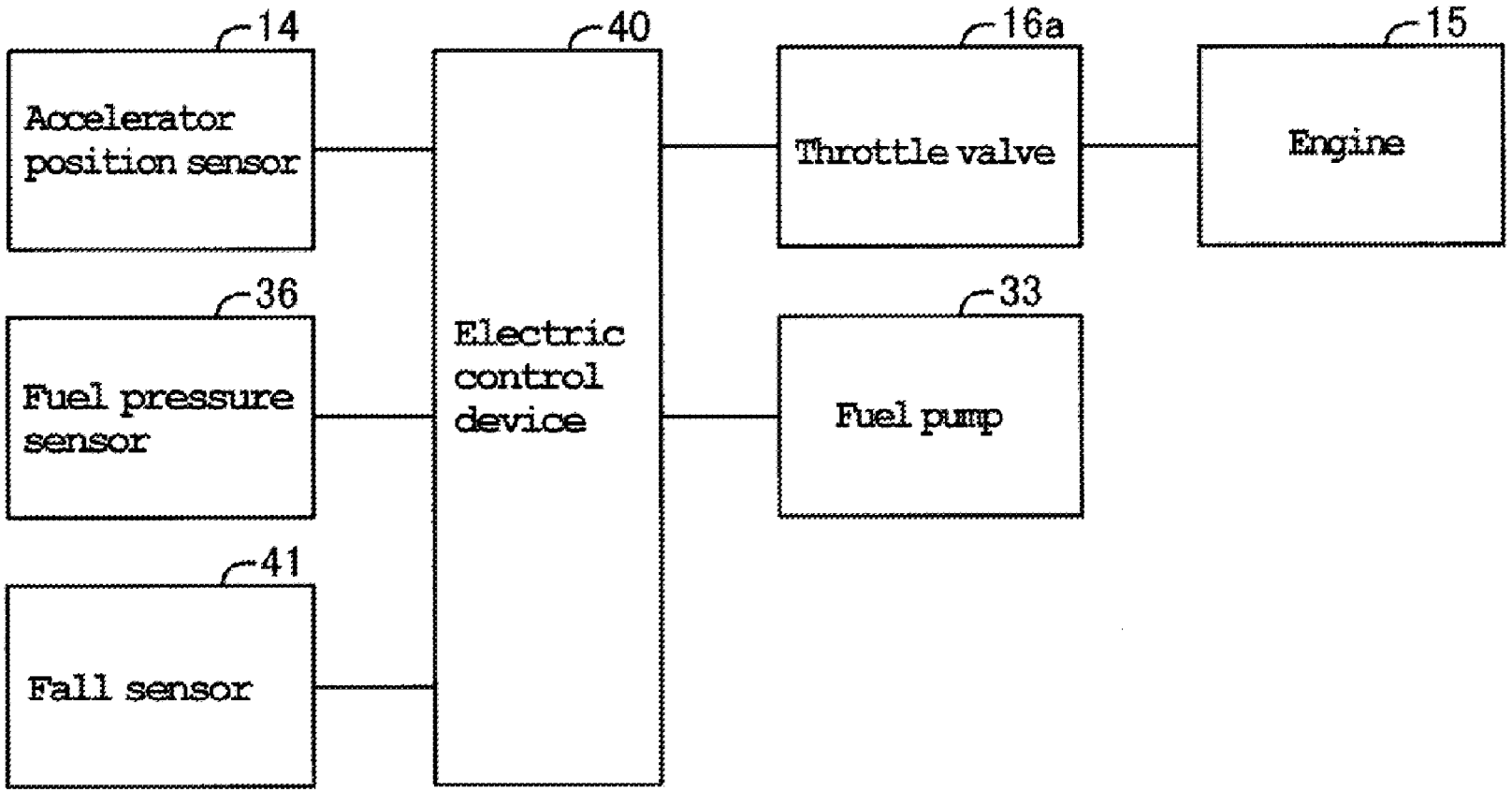
FIG. 7 is a diagram showing respective devices connected to an electric control device.

Also, the water jet propulsion boat 10 according to the present preferred embodiment includes, in addition to the respective devices mentioned above, an electric control device 40 as a control device of a preferred embodiment of the present invention including CPU, ROM, RAM, and a timer as shown in FIG. 7, an electrical component box for housing the various electrical devices, a start switch, and various sensors such as a fall sensor 41 for detecting that the boat body 11 has overturned. An accelerator position sensor 14, a fuel pump 33, a fuel pressure 36, and a fall sensor 41, are respectively connected to the electric control device 40 preferably through a lead wire (not shown), although other wired or wireless connections are possible. The fuel pump 33 performs or stops the operation under the control of CPU according to the program stored in the ROM or various data stored in the RAM.

In the present preferred embodiment, a normal value range of the fuel pressure detected by the fuel pressure sensor 36, data for determining the overturned state detected by the fall sensor 41, and a time period for determining the abnormality occurrence, are stored in the RAM as data. The program contains the information such that the operation of the fuel pump 33 is to be stopped when the detected value of the fuel pressure of the fuel pressure sensor 36 is out of the normal value range or when the fall sensor detects the overturn state. The throttle valve 16*a* is connected to the electric control device 40 through a motor, and operates the engine 15 by the control of the electric control device 40 according to the operation amount of the throttle lever detected by the accelerator position sensor 14.

When the start switch is turned on, the engine starts and the water jet propulsion boat constituted in the above-described manner gets ready to plane. When the operator straddling the seat 13 operates the steering handlebars 12 and a throttle lever, the water jet propulsion boat 10 starts planing in the direction and at the speed each corresponding to the respective operations by the operator. The fuel tank 20 does not easily suffer from the vibration even if a big vibration occurs in the water jet propulsion boat 10 since the fuel tank 20 is supported to the boat body 11 through the vibration absorbing members 21*a* and 21*b*. Therefore, the erratic operation or breakdown of the fuel pressure sensor 36, caused by vibrations, disposed in the fuel pump unit 30 in the fuel tank 20 can be avoided.

The fuel in the fuel tank 20 is sequentially sucked into the pump housing section 32*a*, and its pressure is controlled by the regulator 34, and then discharged into the filter housing section 32*b*, by operation of the fuel pump 33 at the time of planing. At the same time, the fuel pressure is detected by the fuel pressure sensor 36 disposed in the vicinity of the discharge port. The fuel pump 33 continues supplying the fuel to the engine 15 unless the engine 15 is stopped by control as long as the pressure value detected by the fuel pressure sensor 36 is within the normal value range. During that time, the fuel, in which the foreign matters are removed by the filter 35 in the filter housing section 32*b*, is delivered to the engine 15 through the connecting pipe 37, the fuel pipe 39, and the fuel rail 39*a*.

Then, the fall sensor 41 detects the overturned state of the water jet propulsion boat 10 in a case where the water jet propulsion 10 has overturned. At this time, the fuel tank 20 turns upside down and the air pool is formed at the bottom side of the fuel tank 20. For above reason, the air is sucked in the pump housing section 32*a*,and then the pressure values detected by the fuel pressure sensor 36 is decreased to be out of the normal value range. In this case, the fuel pump 33 is stopped under control of the electric control device 40. Then, the fuel supply to the engine 15 is stopped, and the engine 15 stops. The fuel pump 33 also stopped under control of the electric control device 40 when the pressure value detected by the fuel pressure sensor 36 becomes out of the normal value range according to the reasons, other than overturn of the boat, such that the fuel remaining has become low or that an abnormality has occurred in the fuel pump unit 30.

According to this, the air intrusion into the fuel pipe 39 side through the connecting pipe 37 can be avoided. Therefore, a restart of the engine 15 goes smoothly. In addition, in a case the water jet propulsion 10 is overturned but the overturn state lasts only momentarily and the pressure value detected by the fuel pressure sensor 36 remains in the normal value range, the fuel pump 33 continues to supply fuel to the engine 15. Also, the fuel pump 33 may be stopped by a control of the electric control device 40 when the overturned state lasts for a predetermined time period or when the pressure value detected by the fuel pressure sensor 36 is out of the normal value range for longer than a predetermined time period. Also, the fuel pump 33 may be stopped by a control of the electric control device 40 only when the overturn state lasts longer than a predetermined time period and the pressure value detected by the fuel pressure sensor 36 is out of the normal value range during the predetermined time.

As described above, in the water jet propulsion boat 10 according to the present preferred embodiment, the fuel tank 20 is supported on the boat body 11 side through the absorbing members 21*a*, 21*b*, and the fuel pressure sensor 36 is disposed in the fuel pump unit 30 in the fuel tank 20. Therefore, vibrations on the water jet propulsion boat do not transmit to the fuel tank 20 and the fuel pressure sensor 36 in the fuel tank. As a result, the fuel pressure sensor 36 becomes free from the detection error, and at the same time, the lifetime of the fuel pressure sensor 36 becomes longer. If the fuel pump 33 sucks the air, a pressure decrease of the fuel can be detected immediately since the fuel pressure sensor 36 is located in the vicinity of the fuel pump 33.

The fuel pump 33 stops when the fuel pressure sensor 36 detects the decrease of the fuel pressure, therefore the intrusion of the air into the fuel pipe 39 or the engine 15 can be prevented. As a result, the restart ability of the engine can be warranted. In this case, the fuel pump 33 continues the operation to drive the engine 15 as long as the detected value of the fuel pressure sensor 36 is normal, even if the fall sensor 41 detects the overturned state of the water jet propulsion boat. In other words, the overturned state is confirmed and put into an action to stop the engine 15 when the overturned state detected by the fall sensor 41 and the fuel pressure decrease detected by the fuel pressure sensor 36 are both observed. Therefore, unnecessary stoppage of the engine is avoided. Furthermore, the fuel pump unit 30 is provided in the fuel tank 20 and the fuel pressure sensor 36 is provided in the fuel pump unit 30, therefore the man-hours required for the assembly process of the fuel pump unit 30 and the fuel pressure sensor 36 can be reduced. Also, the quantity of necessary parts for assembly can be reduced.

The pressure detection of the fuel can be performed more accurately since the fuel pressure sensor 36 detects the pressure of fuel which has been controlled by the regulator 34. Moreover, the fuel pressure sensor 36 is attached to the pump housing section 32*a*, therefore the fuel pressure sensor is surround by the fuel, resulting in prevention of corrosion by seawater. The filter 35 is disposed downstream of the fuel pressure sensor 36 in the fuel pump unit 30. If the fuel pump 33 sucks the air, the air reaches the fuel pressure sensor 36 before passing the filter 35. Therefore, the fuel pressure sensor 36 can detect the decrease of the fuel pressure immediately. Therefore, the intrusion of the air into the fuel pipe 39 can be avoided securely.

Second Preferred Embodiment

Figure 8:
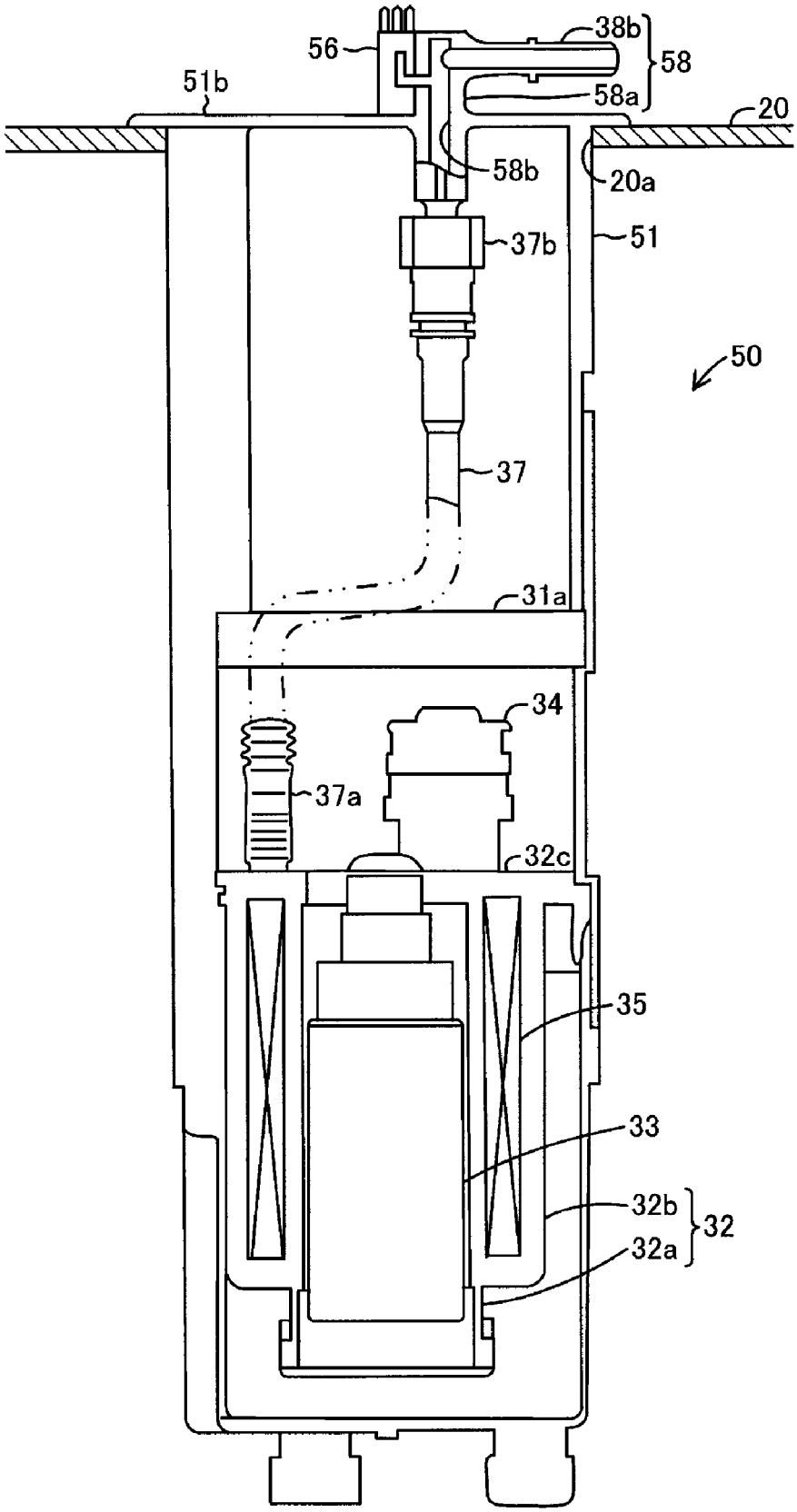
FIG. 8 is a cross sectional view, showing a fuel pump unit of a water jet propulsion boat according to a second preferred embodiment of the present invention.

FIG. 8 shows the fuel pump unit 50 equipped to the water jet propulsion boat according the second preferred embodiment of the present invention. In this fuel pump unit 50, the fuel pressure sensor 56 instead of the above described fuel pressure sensor 36 is disposed on the upper surface 51*b* of the container 51 and in front of the body section 58*a* of the fuel discharge section 58. In other words, the fuel pressure sensor 56 is attached to the fuel discharge section 58 in communication with the fuel conduit 58*b* in the body section 58*a*, and detects the pressure of the fuel running in the fuel conduit 58*b*. Other configurations of the water jet propulsion boat with the fuel pump unit 50 are preferably same as already mentioned water jet propulsion boat 10. It should thus be understood that similar elements are designated by the same reference numerals and the same description will not be repeated.

For above configuration, the maintenance operations such as exchanging or checking of the fuel pressure sensor 56 become easy. The fuel conduit that communicates the fuel pump unit 50 and the fuel pressure detection sensor 56 can be omitted by attaching the fuel pressure detection sensor 56 to the fuel discharge section 58. Other benefits of the water jet propulsion boat with the fuel pump unit 50 are same as already mentioned water jet propulsion boat 10.

Example

Figure 9A:
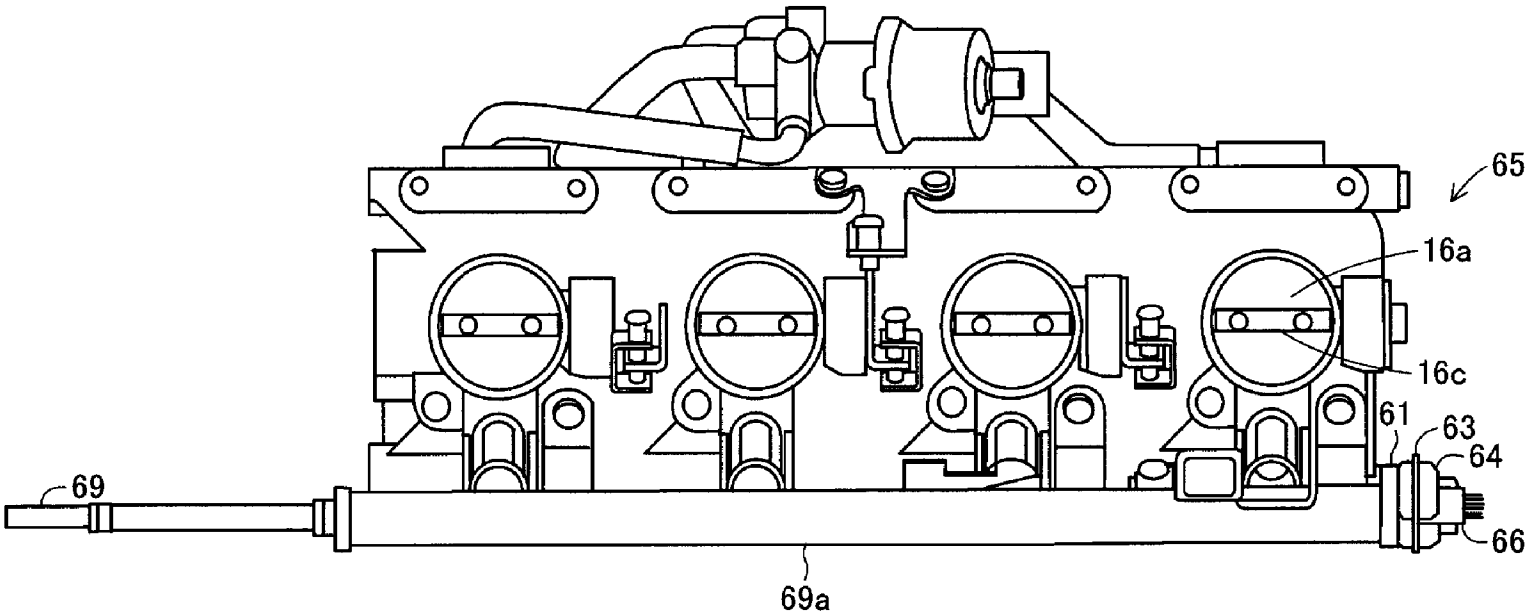
Figure 9B:
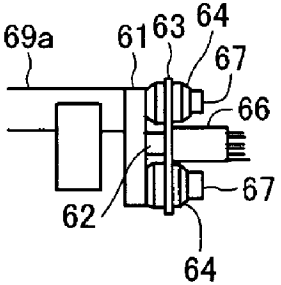

FIGS. 9A and 9B show a fuel pressure sensor 66 according to a reference example. The fuel pressure sensor 66 is provided not on or in the fuel tank but to the end of the fuel rail 69*a* extending from the fuel tank toward the engine 65 through the fuel pipe 69, etc. In other words, the end of the fuel rail 69*a* is opened, and the elliptical attachment plate 61 having a fuel conduit in communication with the opening at the end of the fuel rail 69*a* is mounted to the end section of the fuel rail 69*a*. One portion of the front surface (left surface in FIG. 9A) of the attachment plate 61 is arranged to face to the end of the fuel rail 69*a*. Screw holes (not shown) are formed in the both end portions of the rear surface of the attachment plate 61.

The fuel conduit extends from the one portion of the front surface of the attachment plate 61 to the center in the thickness direction of the attachment plate 61, then bends to extend to the center of the attachment plate 61, then bends again and opens at the center of the rear surface of the attachment plate 61. A short length flexible pipe 62 is attached to the center of the rear surface of the attachment plate 61 in communication with the opening in the rear surface of the attachment plate 61. The fuel pressure sensor 66 is attached to the rear end of the flexible pipe 62 through a supporting plate 63. The supporting plate 63 preferably is an elliptical plate that is thinner than the attachment plate 61. A hole section in communication with the flexible pipe 62 is formed in center of the supporting plate 63. A mount passing hole is formed in both end portions of the supporting plate 63. The fuel pressure sensor 66 is fixed to the supporting plate 63, covering both mount passing holes.

An annular rubber mount 64 having a bolt passing hole is attached to each mount passing hole of the supporting plate 63. The rubber mount 64 is thinner at its center and wider at both ends thereof. One of the wider ends is widened and put onto the mount passing hole. As the widened section resumes its size, the rubber mount 64 stays fixed to the supporting plate 63. The fuel pressure sensor 66 is attached to the attachment plate 61 through the supporting plate 63, in the way that a bolt 67 is inserted from the rear side of each rubber mount 64 to the bolt passing hole and the top section of the bolt 67 is screwed together with the screw hole of the attachment plate 61.

Other configurations of the mounting structure of the fuel pressure sensor 66 are preferably the same as those in FIG. 6. Therefore, the corresponding parts are denoted with the identical reference numerals. As a result of this configuration, a detection error or breakdown does not occur easily even if the fuel pressure sensor 66 is located in the vicinity of the engine 65. That is, in a case where the vibration occurs in the fuel rail 69*a*, the vibration is absorbed in the rubber mount 64, therefore the fuel pressure sensor 66 is able to operate normally.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A water jet propulsion boat propelled by rearwardly ejecting water drawn through a jet pump driven by an engine, the water jet propulsion boat comprising:

a fuel tank disposed in a boat body of the water jet propulsion boat through a supporting member to absorb vibrations;

a fuel pipe extending from the fuel tank to the engine;

a fuel pump unit including a fuel pump that is controlled by a control device to supply fuel from the fuel tank to the engine through the fuel pipe; and a fuel pressure detection device arranged to detect a pressure of fuel supplied to the engine by operation of the fuel pump; wherein the fuel pressure detection device is connected to the control device, and the control device stops the operation of the fuel pump if the fuel pressure detected by the fuel pressure detection device is out of a predetermined normal value range.

2. The water jet propulsion boat according to claim 1, wherein the fuel pump unit is an element of the fuel tank, and the fuel pressure detection device is disposed on the fuel pump unit.

3. The water jet propulsion boat according to claim 1, wherein a regulator arranged to control a pressure of fuel sucked from the fuel tank is disposed on the fuel pump unit, the fuel pressure detection device is disposed downstream side of the fuel pump, and the fuel pressure detection device detects a pressure of fuel that is controlled by the regulator.

4. The water jet propulsion boat according to claim 1, wherein the fuel pressure detection device is disposed in the fuel tank.

5. The water jet propulsion boat according to claim 4, wherein the fuel pressure detection device is disposed in the fuel pump unit, and a filter arranged to remove foreign matters from the fuel sucked into the fuel pump unit through the fuel pump is disposed downstream of the fuel pressure detection device in the fuel pump unit.

6. A water jet propulsion boat propelled by rearwardly ejecting water drawn through a jet pump driven by an engine, the water jet propulsion boat comprising:

a fuel tank disposed in a boat body of the water jet propulsion boat through a supporting member to absorb vibrations;

a fuel pipe extending from the fuel tank to the engine;

a fuel pump unit including a fuel pump that is controlled by a control device to supply fuel from the fuel tank to the engine through the fuel pipe; and a fuel pressure detection device arranged to detect a pressure of fuel supplied to the engine by operation of the fuel pump; wherein the fuel pressure detection device is connected to the control device, and a fall sensor is disposed on the boat body and connected to the control device, wherein the control device stops the operation of the fuel pump if the fall sensor detects an overturning of the boat body and the fuel pressure detected by the fuel pressure detection device is out of the predetermined normal value range.

7. The water jet propulsion boat according to claim 6, wherein the fuel pump unit is an element of the fuel tank, and the fuel pressure detection device is disposed on the fuel pump unit.

8. The water jet propulsion boat according to claim 6, wherein a regulator arranged to control a pressure of fuel sucked from the fuel tank is disposed on the fuel pump unit, the fuel pressure detection device is disposed on a downstream side of the fuel pump, and the fuel pressure detection device detects a pressure of fuel that is controlled by the regulator.

9. The water jet propulsion boat according to claim 6, wherein the fuel pressure detection device is disposed in the fuel tank.

10. The water jet propulsion boat according to claim 9, wherein the fuel pressure detection device is disposed in the fuel pump unit, and a filter arranged to remove foreign matters from the fuel sucked into the fuel pump unit through the fuel pump is disposed downstream of the fuel pressure detection device in the fuel pump unit.

11. A water jet propulsion boat propelled by rearwardly ejecting water drawn through a jet pump driven by an engine, the water jet propulsion boat comprising:

a fuel tank disposed in a boat body of the water jet propulsion boat through a supporting member to absorb vibrations;

a fuel pipe extending from the fuel tank to the engine;

a fuel pump unit including a fuel pump that is controlled by a control device to supply fuel from the fuel tank to the engine through the fuel pipe; and a fuel pressure detection device arranged to detect a pressure of fuel supplied to the engine by operation of the fuel pump; wherein the fuel pump unit is disposed in the fuel tank and at least a portion of the fuel pump unit is exposed above the fuel tank, and the fuel pressure detection device is attached to the at least a portion of the fuel pump unit.

12. The water jet propulsion boat according to claim 11, wherein a fuel discharge section in communication with the fuel pipe is disposed in the exposed section above the upper section of the fuel tank that is upper section of the fuel pump unit, and the fuel pressure detection device is attached to the fuel discharge section.

13. The water jet propulsion boat according to claim 11, wherein a regulator arranged to control a pressure of fuel sucked from the fuel tank is disposed on the fuel pump unit, the fuel pressure detection device is disposed on a downstream side of the fuel pump, and the fuel pressure detection device detects a pressure of fuel that is controlled by the regulator.

14. The water jet propulsion boat according to claim 11, wherein a filter arranged to remove foreign matters from the fuel sucked into the fuel pump unit through the fuel pump is disposed downstream of the fuel pressure detection device in the fuel pump unit.

* * * * *